US005743083A

United States Patent [19]

Schnaibel et al.

[11] Patent Number: 5,743,083

[45] Date of Patent: Apr. 28, 1998

[54] METHOD FOR INTERRUPTING THE METERING OF FUEL DURING OVERRUN OPERATION OF AN INTERNAL COMBUSTION ENGINE

[75] Inventors: Eberhard Schnaibel, Hemmingen; Frank Blischke, Hildesheim, both of Germany

[73] Assignee: Robert Bosch GmbH, Stuttgart, Germany

[21] Appl. No.: 645,274

[22] Filed: May 13, 1996

[30] Foreign Application Priority Data

May 12, 1995 [DE] Germany ..... 195 17 434.8

[51] Int. Cl.[6] ..... F01N 3/20

[52] U.S. Cl. ..... 60/274; 60/276; 60/277; 60/285

[58] Field of Search ..... 60/274, 276, 277, 60/285, 300

[56] References Cited

U.S. PATENT DOCUMENTS

| | | | |
|---|---|---|---|
| 3,818,701 | 6/1974 | Foster et al. | 60/277 |
| 4,023,358 | 5/1977 | Maurer et al. | 60/277 |
| 4,322,947 | 4/1982 | Wössner et al. | 60/285 |
| 5,557,929 | 9/1996 | Sato et al. | 60/277 |
| 5,570,575 | 11/1996 | Sato et al. | 60/277 |

FOREIGN PATENT DOCUMENTS

| | | |
|---|---|---|
| 4325307 | 2/1995 | Germany . |
| 60-151131 | 8/1985 | Japan . |
| 63-201347 | 8/1988 | Japan . |
| 7103031 | 4/1995 | Japan . |
| 7197834 | 8/1995 | Japan . |
| 2277594 | 11/1994 | United Kingdom . |

*Primary Examiner*—Willis R. Wolfe
*Attorney, Agent, or Firm*—Walter Ottesen

[57] ABSTRACT

The invention is directed to a method for interrupting fuel metered to an engine during overrun operation. The engine is equipped with a catalytic converter and the method includes the steps of: determining a criterion for the temperature of the catalytic converter; checking to determine if the criterion satisfies a condition for the temperature of the catalytic converter which is characteristic for a high temperature of the catalytic converter; and, interrupting the metering of fuel to the engine when the condition is not satisfied.

2 Claims, 2 Drawing Sheets

METHOD FOR INTERRUPTING THE METERING OF FUEL DURING OVERRUN OPERATION OF AN INTERNAL COMBUSTION ENGINE

FIELD OF THE INVENTION

The invention relates to a method for interrupting the metering of fuel during overrun operation of an internal combustion engine equipped with a catalytic converter while considering the temperature of the catalytic converter.

BACKGROUND OF THE INVENTION

A method of the kind described above is disclosed in U.S. Pat. No. 4,322,947. In this method, the extent of closure of a throttle flap is detected with the aid of a throttle flap switch. The throttle flap regulates the quantity of air inducted. If this switch signals a closed throttle flap and if the rpm of the engine at the same time exceeds a threshold value of 1000 to 1500 rpm, then this is evaluated as overrun operation and therefore as the first condition for a cutoff of the fuel metering to the engine.

Furthermore, the temperature of the catalytic converter is detected continuously and compared to a threshold value which lies in the range of the operating temperature of the catalytic converter. When the temperature of the catalytic converter exceeds this temperature, a second condition for cutting off fuel metering is established so that an interruption of the metering of fuel in overrun operation takes place only above the above-mentioned temperature.

In this way, the condition is prevented that the temperature of the catalytic converter drops below its operating temperature in an overrun phase of operation because of the cooling action of the comparatively cold exhaust gas present when there is an interruption of the metering of fuel.

A tendency to a comparatively rapid loss of the converting capability of the catalytic converter has been determined in motor vehicles wherein the metering of fuel is interrupted during overrun operation. This disadvantage of fuel cutoff has been accepted up to now because the fuel cutoff overall reduces the consumption and also provides other advantages such as an improved engine braking effect.

SUMMARY OF THE INVENTION

It is an object of the invention to provide a method which maintains the advantages of an interruption of the metering of fuel during overrun operation and which simultaneously avoids the disadvantage of a rapid deterioration of the catalytic converter or at least lessens this deterioration.

The method of the invention is for interrupting fuel metered to an engine during overrun operation and the engine is equipped with a catalytic converter. The method includes the steps of: determining a criterion for the temperature of the catalytic converter; checking to determine if the criterion satisfies a condition for the temperature of the catalytic converter which is characteristic for a high temperature of the catalytic converter; and, interrupting the metering of fuel to the engine when the condition is not satisfied.

A basic concept of the invention is that the fuel cutoff in overrun operation is prevented when the temperature of the catalytic converter is above a critical temperature. In practical motor vehicle operation, this has the consequence that the conventional function of the cutoff of the metering of fuel is maintained in most cases so that the above-mentioned advantages are preserved. With the method of the invention, forbidding cutoff of the metering of fuel is limited to a few special cases, for example, after a longer operation at high and very high power. In this way, on the one hand, the driving performance in normal operation of the motor vehicle is not affected and, on the other hand, the deterioration of the catalytic converter is avoided. This deterioration is accelerated at high catalytic converter temperatures by the excess of oxygen associated with the cutoff of fuel.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
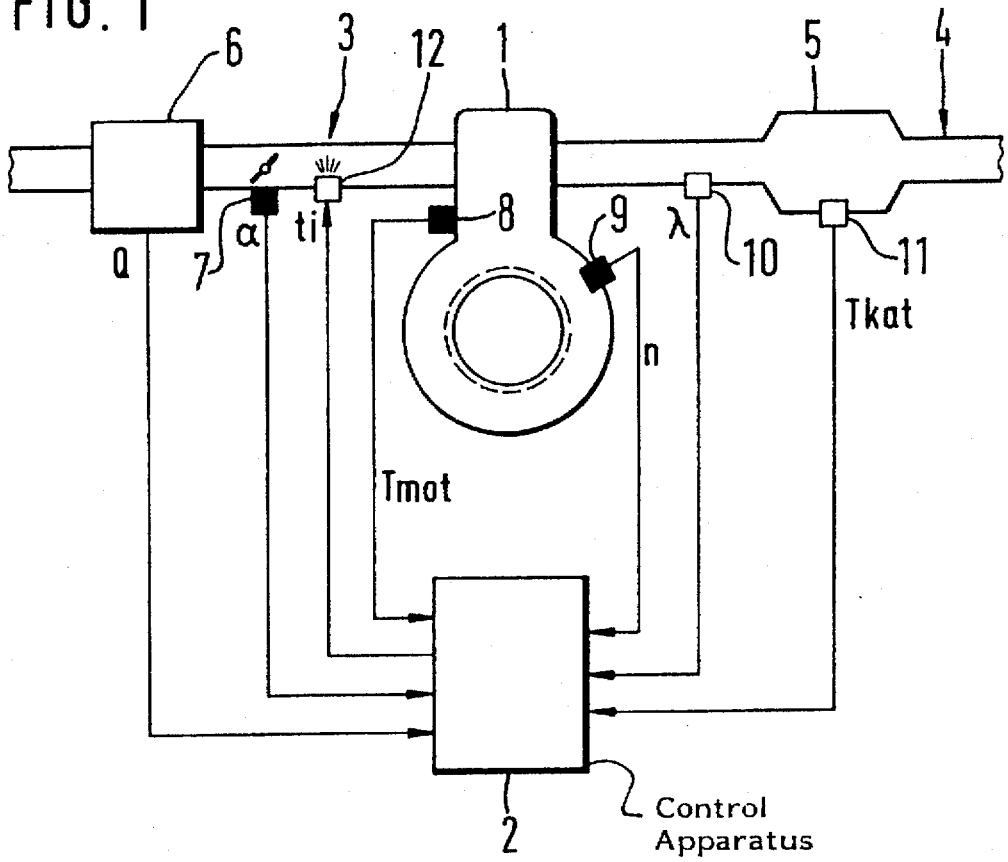
FIG. 1 is a first example of an arrangement suitable for carrying out the method of the invention.

FIG. 1 shows an internal combustion engine 1 having a control apparatus 2, an intake system 3 and an exhaust-gas system 4 equipped with a catalytic converter 5. Sensors 6 to 11 are provided for detecting various operating variables which supply the quantities to the control apparatus as follows: the air Q inducted by the engine (sensor 6), the angular position $\alpha$ of a throttle flap 12 (sensor 7), the temperature Tmot (sensor 8) of the engine and the rpm (n) of the engine (sensor 9), the oxygen content of the exhaust gas ($\lambda$, sensor 10) and the temperature Tkat of the catalytic converter (sensor 11). The control apparatus 2 processes these signals to control the engine, inter alia, to form the fuel metering signal ti for driving a fuel metering device 12.

In the context of the invention, the basic function of the above arrangement is to supply an air/fuel mixture of a desired composition for all operating points which are defined by the various input parameters.

Figure 2:
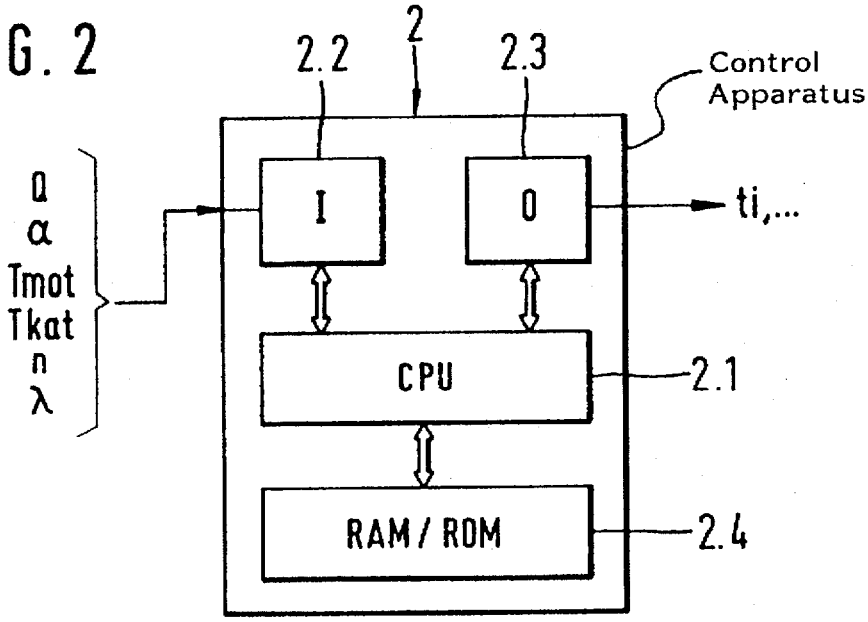
FIG. 2 is a schematic representation of the structure of the control apparatus of FIG. 1 suitable for carrying out the method of the invention.

For this purpose, the control apparatus can operate in principle in accordance with the schematic of FIG. 2. In accordance with this schematic, a central computer unit 2.1 arbitrates between an input unit 2.2 and an output unit 2.3 while accessing programs and data which are stored in a memory unit 2.4.

Figure 3:
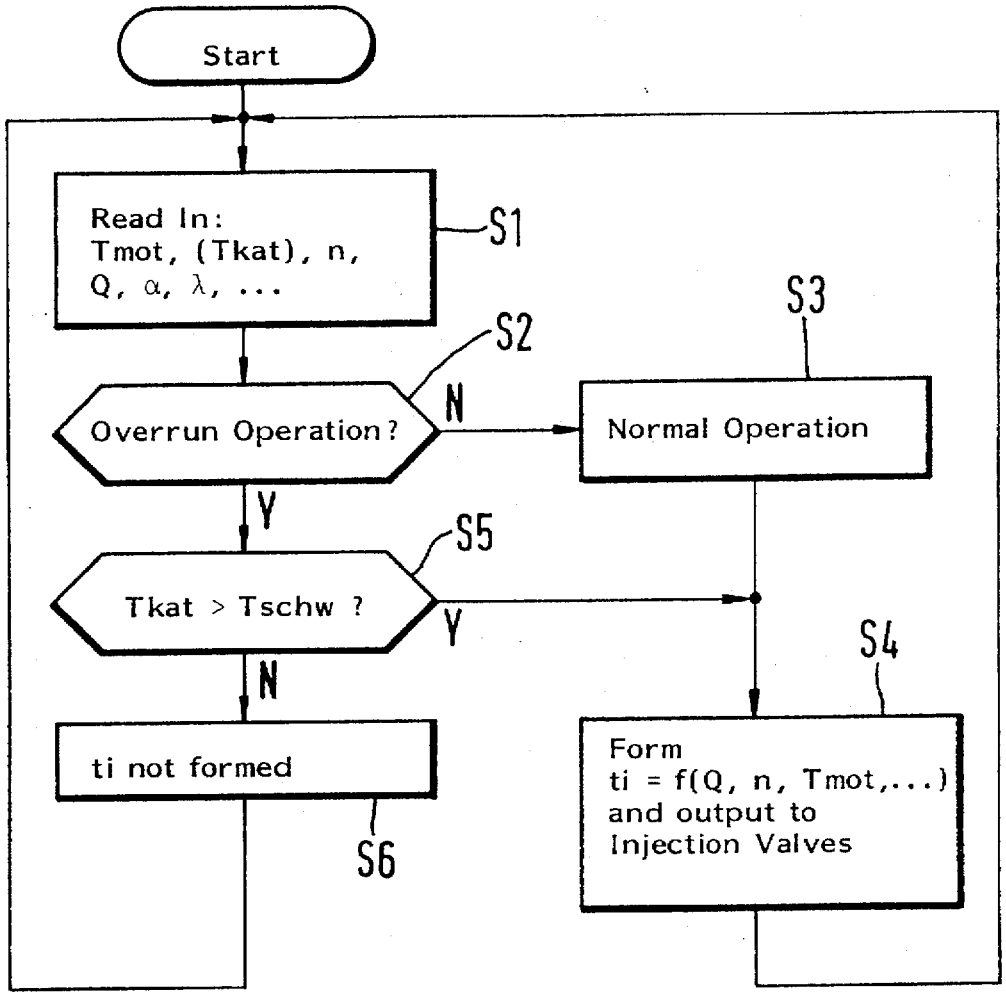
FIG. 3 shows an embodiment of the method of the invention in the context of a flowchart; and, FIG. 4 shows the conditions under which no fuel cutoff can take place in overrun operation.

An embodiment of the method of the invention is shown as a flowchart in FIG. 3. After the start of the method, the above-mentioned input parameters are read in in a step S1. Step S2 includes an inquiry as to whether overrun operation is present as a first condition for a cutoff of the metering of fuel. This overrun operation can be characterized, for example, by a closed throttle flap while at the same time an rpm threshold, which lies above the idle rpm, is exceeded. This condition is, for example, then satisfied when the driver of the motor vehicle utilizes the braking action of the engine as is the case when driving downhill. If this inquiry is answered in the negative, then the program branches via step S3 into normal operation which is followed by the formation of a fuel metering signal in step S4. The fuel metering signal can, for example, be an injection pulse width ti which is transmitted to one or several injection valves.

This step sequence is characteristic for normal operation and is run through cyclically in a time raster of the injections.

If overrun operation occurs in the further course, then the inquiry in step S2 is answered in the positive and an inquiry step S5 is reached wherein the temperature Tkat of the catalytic converter is compared to a threshold value Tschw. Excluding an exception to be described later, this threshold value, which lies in the upper range of the temperature permissible for the catalytic converter, is not reached. The inquiry in step S5 is therefore answered in the negative. The formation of ti in step S4 is therefore not reached as long as overrun operation is present. This is emphasized in FIG. 3 by the block S6 which symbolizes the cutoff of the metering of fuel.

If the engine is operated for a longer time at high power, then the temperature Tkat of the catalytic converter reaches a high value (approximately greater than 850° C.) when compared to operation at lower power. A cutoff of the metering of fuel in the overrun operation would, in principle, bring with it a cooling by the comparatively lower exhaust gas; however, other disadvantages are connected with this positive effect. Thus, increased deterioration because of a partially irreversible oxidation of the catalytic converter material occurs as a consequence of the oxygen surplus at a simultaneously high temperature of the converter. To prevent this intensified deterioration and according to the invention, a cutoff of the metering of fuel is only permitted when the temperature Tkat is below the threshold Tschw during overrun operation (see step sequence S5 and S6 in FIG. 3). If, in contrast, the value Tschw is exceeded, then the program branches from step S5 notwithstanding the presence of overrun operation in step S4, that is, to form and output fuel metering signals. Stated otherwise, the metering of fuel to the engine is not interrupted in this case.

The temperature of the catalytic converter can, for example, be detected by a temperature sensor coupled thermally to the catalytic converter. Such a coupling is given with an exhaust-gas sensor mounted structurally near the converter. For this reason, a conclusion can be drawn from the temperature of the exhaust-gas probe as to the temperature of the catalytic converter. The temperature of the exhaust-gas probe is known, inter alia, from a measurement of the internal resistance of the probe or by evaluating the probe signal. The temperature of the catalytic converter can, however, also be computed in accordance with a model from operating parameters of the engine, such as load and rpm, with the aid of relationships which are to be determined empirically. This has the advantage that a special sensor for the temperature of the catalytic converter is not necessary.

Figure 4:
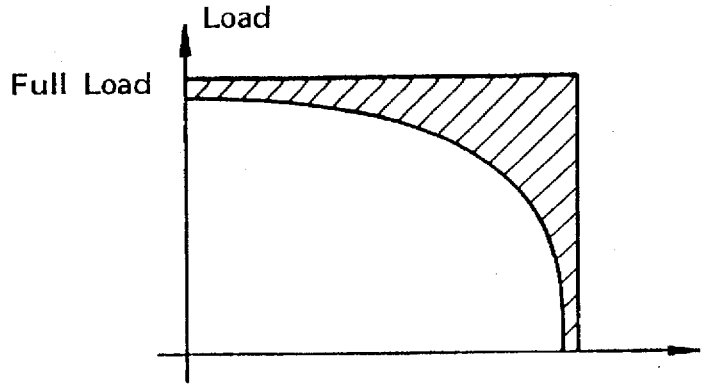

It is especially possible to assign specific regions of a plane defined by load and rpm values to high catalytic converter temperatures and the fuel cutoff is inhibited when the engine has been operated for a certain time span before the overrun phase of operation in these load/rpm regions. Corresponding regions are shown hatched in FIG. 4.

In lieu of a combination of load and rpm, one of the parameters can be utilized by itself as a decision criterion in a simplified embodiment so that a cutoff of the metering of fuel is prevented when the engine has been operated at a high load or high rpm before an overrun phase of operation.

The overrun operation can also be defined by a drop below a threshold as an alternative to a definition via a closed throttle flap. For example, if, in the course of forming the injection pulse width ti, a load signal t1 proportional to Q/n is formed and standardized to a single stroke of the engine, then overrun operation can be defined by a drop below a t1-threshold which can also be dependent upon rpm.

It is understood that the foregoing description is that of the preferred embodiments of the invention and that various changes and modifications may be made thereto without departing from the spirit and scope of the invention as defined in the appended claims.

What is claimed is:

1. A method for interrupting fuel metered to an engine during overrun operation, the engine being equipped with a catalytic converter and having a parameter representing the load state on the engine, said engine being driven with said parameter shortly before reaching said overrun mode of operation; and, said method comprising the steps of:

determining a criterion for the temperature of the catalytic converter to be said parameter;

utilizing said parameter as said criterion for the temperature of said catalytic converter;

checking to determine if said criterion satisfies a condition for the temperature of the catalytic converter which is characteristic for a high temperature of said catalytic converter;

providing a load threshold; and, considering said condition as being satisfied when said load threshold is exceeded and interrupting the metering of fuel to said engine when said condition is not satisfied.

2. A method for interrupting fuel metered to an engine during overrun operation, the engine being equipped with a catalytic converter and having operating variables, the method comprising the steps of:

determining a criterion for the temperature of the catalytic converter;

forming said criterion for the temperature of said catalytic converter by modeling from said operating characteristic variables of said engine;

checking to determine if said criterion satisfies a condition for the temperature of the catalytic converter which is characteristic for a high temperature of said catalytic converter;

utilizing value pairs as said criterion for the temperature of said catalytic converter, each value pair including a parameter representing the state of the load on the engine and the engine speed shortly before said overrun operation is reached; and, considering said condition satisfied when said value pairs lie in specific regions of a plane defined by said load and said engine speed and interrupting the metering of fuel to said engine when said condition is not satisfied.

* * * * *